US011690457B2

(12) United States Patent
Koch

(10) Patent No.: US 11,690,457 B2
(45) Date of Patent: Jul. 4, 2023

(54) CHAIR WITH FLEXIBLE INTERNAL SUPPORT

(71) Applicant: HNI Technologies Inc., Muscatine, IA (US)

(72) Inventor: John Koch, Muscatine, IA (US)

(73) Assignee: HNI TECHNOLOGIES INC., Muscatine, IA (US)

( * ) Notice: Subject to any disclaimer, the term of this patent is extended or adjusted under 35 U.S.C. 154(b) by 0 days.

(21) Appl. No.: 17/166,968

(22) Filed: Feb. 3, 2021

(65) Prior Publication Data

US 2021/0235872 A1 Aug. 5, 2021

Related U.S. Application Data

(60) Provisional application No. 62/970,048, filed on Feb. 4, 2020.

(51) Int. Cl.

| | |
|---|---|
| ***A47C 5/12*** | (2006.01) |
| ***A47C 7/18*** | (2006.01) |
| ***A47C 7/28*** | (2006.01) |
| ***A47C 7/40*** | (2006.01) |

(52) U.S. Cl.

CPC ..... *A47C 7/185* (2013.01); *A47C 7/282* (2013.01); *A47C 7/40* (2013.01); *A47C 5/12* (2013.01)

(58) Field of Classification Search

CPC .. A47C 7/185; A47C 7/40; A47C 5/12; A47C 7/282

USPC ..... 297/452.13, 452.14, 452.15, 452.56, 297/452.57, 452.58, 452.59, 452.6, 297/452.61, 452.62, 452.63, 452.64, 297/452.65; D6/366

See application file for complete search history.

(56) References Cited

U.S. PATENT DOCUMENTS

| | | | | |
|---|---|---|---|---|
| 4,660,887 A * | 4/1987 | Fleming | A47C 7/405 297/452.15 X |
| 4,744,603 A * | 5/1988 | Knoblock | A47C 3/245 297/300.4 |
| 4,892,356 A * | 1/1990 | Pittman | A47C 3/12 297/452.15 |
| 5,100,201 A | 3/1992 | Becker et al. | |
| 5,102,196 A * | 4/1992 | Kaneda | A47C 7/405 297/452.15 X |

(Continued)

FOREIGN PATENT DOCUMENTS

| | | |
|---|---|---|
| AU | 2001065653 | 4/2002 |
| CA | 2881691 A1 | 3/2014 |

(Continued)

*Primary Examiner* — Rodney B White

(74) *Attorney, Agent, or Firm* — Faegre Drinker Biddle & Reath LLP

(57) ABSTRACT

The present disclosure relates to a chair back assembly with an outer frame and an inner frame, wherein the outer frame is manufactured of different material than the inner frame to allow for a variety in support throughout the chair back assembly, resulting in localized support throughout the back of the chair. The availability of localized support results in an improvement in comfort and may also improve production in embodiments utilizing a foam covering. Specifically, the inner frame of the chair back assembly may include at least one vertical member and at least one horizontal member to provide additional support to the user.

16 Claims, 5 Drawing Sheets

(56) References Cited

U.S. PATENT DOCUMENTS 5,318,346 A * 6/1994 Roossien ..... A47C 3/12 297/452.15 X
5,333,934 A * 8/1994 Knoblock ..... A47C 3/18 297/452.15
5,338,099 A * 8/1994 Ishi ..... A47C 1/03277 297/452.33
5,352,022 A * 10/1994 Knoblock ..... A47C 1/03255 297/452.15
5,378,040 A 1/1995 Chaney et al.
5,487,591 A * 1/1996 Knoblock ..... A47C 3/18 297/452.14
5,540,481 A * 7/1996 Roossien ..... A47C 3/12 297/300.4
5,611,598 A * 3/1997 Knoblock ..... A47C 3/12 297/452.14
5,662,381 A * 9/1997 Roossien ..... A47C 3/12 297/452.15 X
5,906,416 A * 5/1999 Rasmussen ..... A61G 5/12 297/452.33
5,934,758 A * 8/1999 Ritch ..... A47C 7/14 297/452.54
5,961,184 A * 10/1999 Balderi ..... A47C 7/70 297/448.1
6,131,993 A * 10/2000 Pesta ..... B60R 7/043 297/183.7
6,257,665 B1 * 7/2001 Nagamitsu ..... A47C 7/405 297/452.15 X
6,382,719 B1 5/2002 Heidmann et al.
6,419,318 B1 * 7/2002 Albright ..... A47C 7/462 297/284.4
6,626,497 B2 * 9/2003 Nagamitsu ..... A47C 7/40 297/452.15
6,669,292 B2 12/2003 Koepke et al.
6,783,184 B2 * 8/2004 DiBattista ..... B29C 49/20 297/452.14
7,216,933 B2 * 5/2007 Schmidt ..... A47C 7/465 297/284.4
7,347,495 B2 3/2008 Beyer et al.
7,604,298 B2 * 10/2009 Peterson ..... A47C 7/462 297/353
7,625,044 B2 12/2009 Piretti
7,654,616 B2 2/2010 Kinoshita et al.
7,841,666 B2 * 11/2010 Schmitz ..... A47C 1/03 297/440.2
8,251,454 B2 * 8/2012 Tsukiji ..... A47C 7/40 297/452.13 X
8,602,501 B2 * 12/2013 Walker ..... A47C 7/42 297/452.15
D715,068 S * 10/2014 Chan ..... D6/366
8,876,209 B2 * 11/2014 Peterson ..... A47C 7/44 297/452.15 X
8,973,990 B2 * 3/2015 Krupiczewicz ..... A47C 31/11 297/452.57 X
8,998,338 B2 * 4/2015 Vander Veen ..... A47C 1/0307 297/452.55
8,998,339 B2 * 4/2015 Peterson ..... A47C 7/24 297/452.56
9,332,851 B2 * 5/2016 Machael ..... A47C 7/445
9,462,891 B2 10/2016 Kikuchi et al.
9,913,539 B2 3/2018 Potrykus et al.
10,016,061 B2 * 7/2018 Brueske ..... A47C 7/462
10,064,493 B2 * 9/2018 Machael ..... A47C 7/44
10,172,464 B2 1/2019 Cassaday
10,172,465 B2 * 1/2019 Machael ..... A47C 5/12
10,182,657 B2 * 1/2019 Beyer ..... A47C 7/40
10,219,627 B2 * 3/2019 Deevers ..... A47C 7/16
10,264,889 B2 4/2019 Battey et al.
D879,491 S * 3/2020 Wang ..... D6/366
10,729,250 B2 * 8/2020 Beyer ..... A47C 7/462
10,791,842 B2 * 10/2020 Peterson ..... A47C 7/405
10,820,705 B2 * 11/2020 Deevers ..... A47C 7/027
D912,417 S * 3/2021 Chen ..... D6/366
D937,593 S * 12/2021 Ni et al. ..... D6/366
2002/0190552 A1 12/2002 Koepke et al.
2003/0042783 A1 * 3/2003 Potes ..... A47C 7/282 297/452.56
2003/0127896 A1 7/2003 Deimen et al.
2004/0032156 A1 2/2004 Stipek
2004/0245825 A1 * 12/2004 Battey ..... A47C 7/38 297/284.4
2004/0245827 A1 * 12/2004 Bedford ..... A47C 7/38 297/300.1
2005/0248189 A1 * 11/2005 Prasatek ..... B60N 2/68 297/188.04
2006/0071522 A1 * 4/2006 Bedford ..... A47C 7/025 297/300.2
2006/0175884 A1 * 8/2006 Jenkins ..... A47C 7/445 297/300.4
2007/0267911 A1 11/2007 Kinoshita et al.
2008/0217977 A1 * 9/2008 Aldrich ..... A47C 1/03255 297/284.3
2010/0033002 A1 2/2010 Di Giusto et al.
2010/0117433 A1 * 5/2010 Cassaday ..... A47C 7/40 297/452.46
2010/0133893 A1 6/2010 Raftery et al.
2012/0212027 A1 * 8/2012 Nakayama ..... A47C 1/03283 297/452.18
2012/0223566 A1 * 9/2012 Nakayama ..... A47C 1/03255 297/452.18
2013/0169014 A1 7/2013 Machael et al.
2014/0077541 A1 * 3/2014 Krupiczewicz ..... A47C 7/02 297/224
2014/0077542 A1 * 3/2014 Vander Veen ..... A47C 1/03274 297/228.11
2014/0077548 A1 * 3/2014 Peterson ..... A47C 7/02 297/284.4
2014/0077549 A1 * 3/2014 Battey ..... A47C 7/006 297/284.7
2014/0077551 A1 * 3/2014 Battey ..... A47C 7/44 297/300.1
2014/0077552 A1 * 3/2014 Battey ..... A47C 7/40 297/300.1
2014/0077553 A1 * 3/2014 Battey ..... A47C 1/032 297/301.4
2014/0077555 A1 * 3/2014 Battey ..... A47C 3/30 297/340
2014/0077556 A1 * 3/2014 Battey ..... A47C 7/443 297/340
2014/0077557 A1 * 3/2014 Battey ..... A47C 3/30 297/340
2014/0077571 A1 * 3/2014 Vander Veen ..... A47C 7/441 297/452.1
2014/0077572 A1 * 3/2014 Vander Veen ..... A47C 1/024 297/452.1
2014/0084652 A1 * 3/2014 Norman ..... A47C 7/24 297/284.1
2015/0042139 A1 * 2/2015 Namekawa ..... A47C 3/00 297/338
2015/0091353 A1 4/2015 Horn
2015/0157127 A1 * 6/2015 Peterson ..... A47C 1/024 297/284.8
2015/0157128 A1 * 6/2015 Battey ..... A47C 7/441 297/303.4
2015/0164226 A1 * 6/2015 Battey ..... A47C 7/46 297/316
2015/0164227 A1 * 6/2015 Battey ..... A47C 31/023 297/284.4
2015/0164230 A1 * 6/2015 Smith ..... A47C 1/03261 297/452.1
2015/0250319 A1 * 9/2015 Burwell ..... A47C 1/03255 264/292
2015/0265053 A1 * 9/2015 Battey ..... A47C 1/0307 297/300.2
2015/0296989 A1 * 10/2015 Machael ..... A47C 7/462 297/284.7
2015/0305505 A1 * 10/2015 Peterson ..... A47C 3/20 29/428
2015/0321614 A1 * 11/2015 Line ..... B60N 2/68 297/188.04

(56) References Cited

U.S. PATENT DOCUMENTS

| | | | | |
|---|---|---|---|---|
| 2016/0029801 | A1 | 2/2016 | Potrykus et al. | |
| 2016/0081477 | A1* | 3/2016 | Coffield | A47C 7/40 297/452.18 |
| 2016/0135603 | A1* | 5/2016 | Chan | A47C 7/36 297/284.7 |
| 2016/0206105 | A1 | 7/2016 | Wagner | |
| 2016/0309901 | A1* | 10/2016 | Battey | A47C 7/004 |
| 2016/0360889 | A1* | 12/2016 | Matlin | A47C 7/40 |
| 2016/0367029 | A1* | 12/2016 | Battey | A47C 5/00 |
| 2017/0007022 | A1* | 1/2017 | Battey | A47C 1/0308 |
| 2017/0245642 | A1* | 8/2017 | Smith | A47C 7/004 |
| 2018/0042384 | A1* | 2/2018 | Battey | A47C 7/185 |
| 2018/0116405 | A1 | 5/2018 | Gerbino et al. | |
| 2018/0160813 | A1* | 6/2018 | Battey | A47C 7/44 |
| 2018/0177301 | A1 | 6/2018 | Norman et al. | |
| 2018/0271292 | A1 | 9/2018 | Wu | |
| 2019/0133322 | A1* | 5/2019 | Peterson | A47C 7/006 |
| 2019/0133323 | A1* | 5/2019 | Battey | A47C 1/14 |
| 2019/0133326 | A1* | 5/2019 | Battey | A47C 3/20 |
| 2019/0167007 | A1* | 6/2019 | Deevers | A47C 7/46 |
| 2020/0288871 | A1* | 9/2020 | Deevers | A47C 31/023 |
| 2020/0345142 | A1* | 11/2020 | Battey | A47C 7/54 |
| 2021/0204699 | A1* | 7/2021 | Deevers | A47C 1/03255 |
| 2021/0227981 | A1* | 7/2021 | Battey | A47C 1/03266 |
| 2021/0401181 | A1* | 12/2021 | Putman | A47C 31/023 |

FOREIGN PATENT DOCUMENTS

| | | | | |
|---|---|---|---|---|
| CA | 2956562 | A1 | 8/2017 | |
| DE | 102018123731 | A1 * | 3/2020 | A47C 7/462 |
| EP | 1226773 | A1 | 7/2002 | |
| EP | 0979050 | A4 | 11/2002 | |
| EP | 1215981 | A4 | 4/2005 | |
| EP | 3245901 | A1 | 11/2017 | |
| GB | 0466729 | A | 6/1937 | |
| GB | 0973731 | A | 10/1964 | |
| HK | 1010664 | A1 | 6/1999 | |
| HK | 1017597 | | 11/1999 | |
| IN | 215418 | | 4/2007 | |
| KR | 30-0790204 | | 3/2015 | |
| KR | 10-2015-0134905 | A | 12/2015 | |
| WO | 98/48671 | A1 | 11/1998 | |
| WO | 01/22849 | A1 | 4/2001 | |

* cited by examiner

CHAIR WITH FLEXIBLE INTERNAL SUPPORT

CROSS-REFERENCE TO RELATED APPLICATION

This application claims priority to Provisional Application No. 62/970,048, filed Feb. 4, 2020, which is herein incorporated by reference in its entirety.

BACKGROUND

Chair backs are designed to meet a variety of criteria, including user acceptance, and manufacturability. Improvements are sought to provide users with chair backs that are comfortable, provide adequate support, and are able to be manufactured effectively. The wide selection of available design materials and ergonomic design considerations present a nearly limitless set of possible design selections, not to mention the associated aesthetic design considerations that come into play.

SUMMARY

The present disclosure relates to molded chair back assemblies that can achieve a variety of benefits, including ease of manufacturability and desirable form, fit and function. The combination of a webbing, or web material with a molded secondary material, such as a foam, has been found to promote a variety of these considerations. Thus, various examples relate to a chair back assembly with an outer frame and an inner frame, where the outer frame is manufactured of different material than the inner frame to allow for varying support throughout the chair back assembly, resulting in varying, localized support throughout the back of the chair. The availability of localized support results in an improvement in comfort and may also improve production in embodiments utilizing a molded, foam covering. Specifically, the inner frame of the chair back assembly may include a framework, or webbing of at least one vertical member and at least one horizontal member that define a closed cell framework with an associated foam filler that provides tailored support to a human back.

In an example ("Example 1") of the present disclosure, a chair back assembly is disclosed. The chair back assembly comprises an outer frame defining an open central region and being formed of a frame material; an inner frame coupled to the outer frame defining a central longitudinal axis and a central latitudinal axis, the inner frame extending across the open central region of the outer frame, the inner frame formed of a web material including a crossing-pattern of inner frame elements that define a plurality of closed cells that are symmetric in shape about the central longitudinal axis of the inner frame, the frame material being relatively more rigid than the web material; and a foam layer enveloping the outer frame and the inner frame and filling the closed cells of the inner frame.

In another example ("Example 2") of the present disclosure, a method of manufacturing a chair back is disclosed. The method provides the steps of forming an outer frame defining an open central region and being formed of a frame material; forming an inner frame defining a central longitudinal axis and a central latitudinal axis, the inner frame being formed of a web material including a crossing-pattern of inner frame elements that define a plurality of closed cells that are symmetric in shape about the central longitudinal axis of the inner frame, wherein the web material is relatively less rigid than the frame material; coupling the inner frame to the outer frame so that the inner frame stretches across the open central region of the outer frame; placing the coupled inner frame and outer frame into a chair mold; and pouring liquid foam into the chair mold to cover the coupled inner frame and outer frame.

The inner frame elements of Example 1 or Example 2 may include a first vertical frame element and a second vertical frame element, such that the plurality of closed cells define a first vertical zone, a second vertical zone, and a third vertical zone, the first vertical zone being separated from the second vertical zone by the first vertical frame element and the second vertical zone being separated from the third vertical zone by the second vertical frame element. The first and second frame elements may diverge from one another in a downward direction from a top of the inner frame element toward a bottom of the inner frame, such that the first and third vertical zones decrease in width in a downward direction from a top of the inner frame element toward a bottom of the inner frame.

The inner frame elements of Example 1 or Example 2 may include a plurality of horizontal frame elements such that the plurality of closed cells define a plurality of horizontal zones separated by the plurality of horizontal frame elements. A first set of the plurality of horizontal frame elements may extend across a width of the inner frame with an upward curvature and a second set of the plurality of horizontal frame elements may extend across a width of the inner frame with a downward curvature, the first set being located on an upper portion of the inner frame and the second set being located on a lower portion of the inner frame.

A mid-region of the inner frame of Example 1 or Example 2 may define a saddle-shape. A majority of the plurality of closed cells of Example 1 or Example 2 may be generally quadrilateral in shape. The frame material of Example 1 or Example 2 may be glass-reinforced nylon. The web material of Example 1 or Example 2 may be thermoplastic vulcanizate. The inner frame and the outer frame of Example 1 or Example 2 may be coupled through the process of heat-staking. The outer frame of Example 1 or Example 2 may include a first side, second side, a top, and a bottom defining a continuous perimeter encircling the open central region.

While multiple embodiments are disclosed, still other embodiments within the inventive scope of the disclosure will become apparent to those skilled in the art from the following drawings and detailed description, which shows and describes illustrative embodiments. Accordingly, the drawings and detailed description are to be regarded as illustrative in nature and not restrictive.

BRIEF DESCRIPTION OF THE DRAWINGS

A detailed description of the drawings particularly refers to the accompanying figures in which.

DETAILED DESCRIPTION

Figure 1:
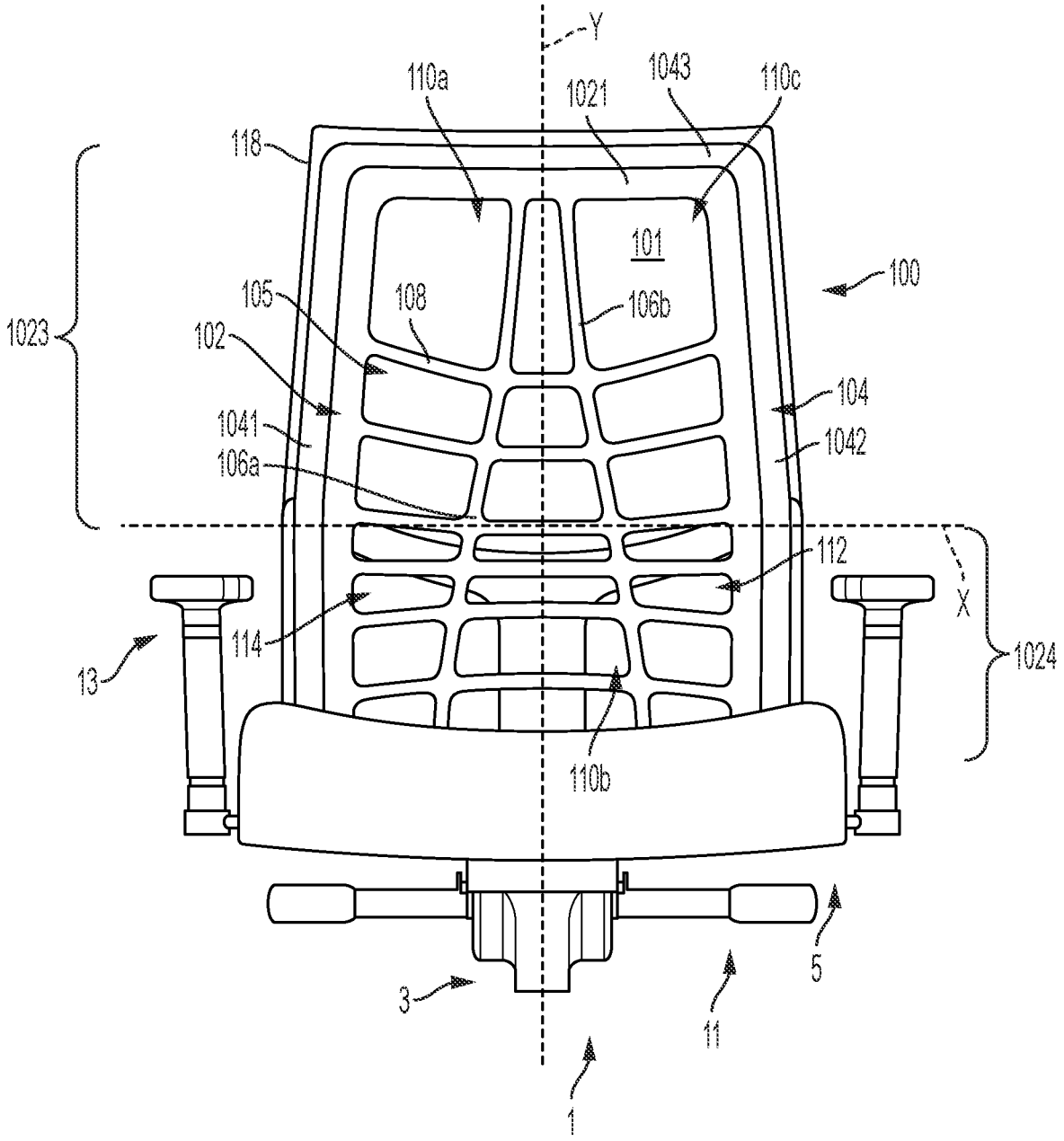
FIG. 1 is a front view of an exemplary embodiment of a chair back of the present invention, including a web-like structure which comprises an inner frame of the chair back, wherein the inner frame of the chair back is melted onto or otherwise coupled to an outer frame of the chair back.

Persons skilled in the art will readily appreciate that various aspects of the present disclosure can be realized by any number of methods and apparatus configured to perform the intended functions. It should also be noted that the accompanying drawing figures referred to herein are not necessarily drawn to scale but may be exaggerated to illustrate various aspects of the present disclosure, and in that regard, the drawing figures should not be construed as limiting.

Definitions and Terminology

With respect terminology of inexactitude, the terms "about" and "approximately" may be used, interchangeably, to refer to a measurement that includes the stated measurement and that also includes any measurements that are reasonably close to the stated measurement. Measurements that are reasonably close to the stated measurement deviate from the stated measurement by a reasonably small amount as understood and readily ascertained by individuals having ordinary skill in the relevant arts. Such deviations may be attributable to measurement error or minor adjustments made to optimize performance, for example. In the event it is determined that individuals having ordinary skill in the relevant arts would not readily ascertain values for such reasonably small differences, the terms "about" and "approximately" can be understood to mean plus or minus 10% of the stated value.

Certain terminology is used herein for convenience only. For example, words such as "top", "bottom", "upper," "lower," "left," "right," "horizontal," "vertical," "upward," and "downward" merely describe the configuration shown in the figures or the orientation of a part in the installed position. Indeed, the referenced components may be oriented in any direction. Similarly, throughout this disclosure, where a process or method is shown or described, the method may be performed in any order or simultaneously, unless it is clear from the context that the method depends on certain actions being performed first.

This disclosure is not meant to be read in a restrictive manner. For example, the terminology used in the application should be read broadly in the context of the meaning those in the field would attribute such terminology.

Descriptions of the Disclosed Embodiments

Figure 2:
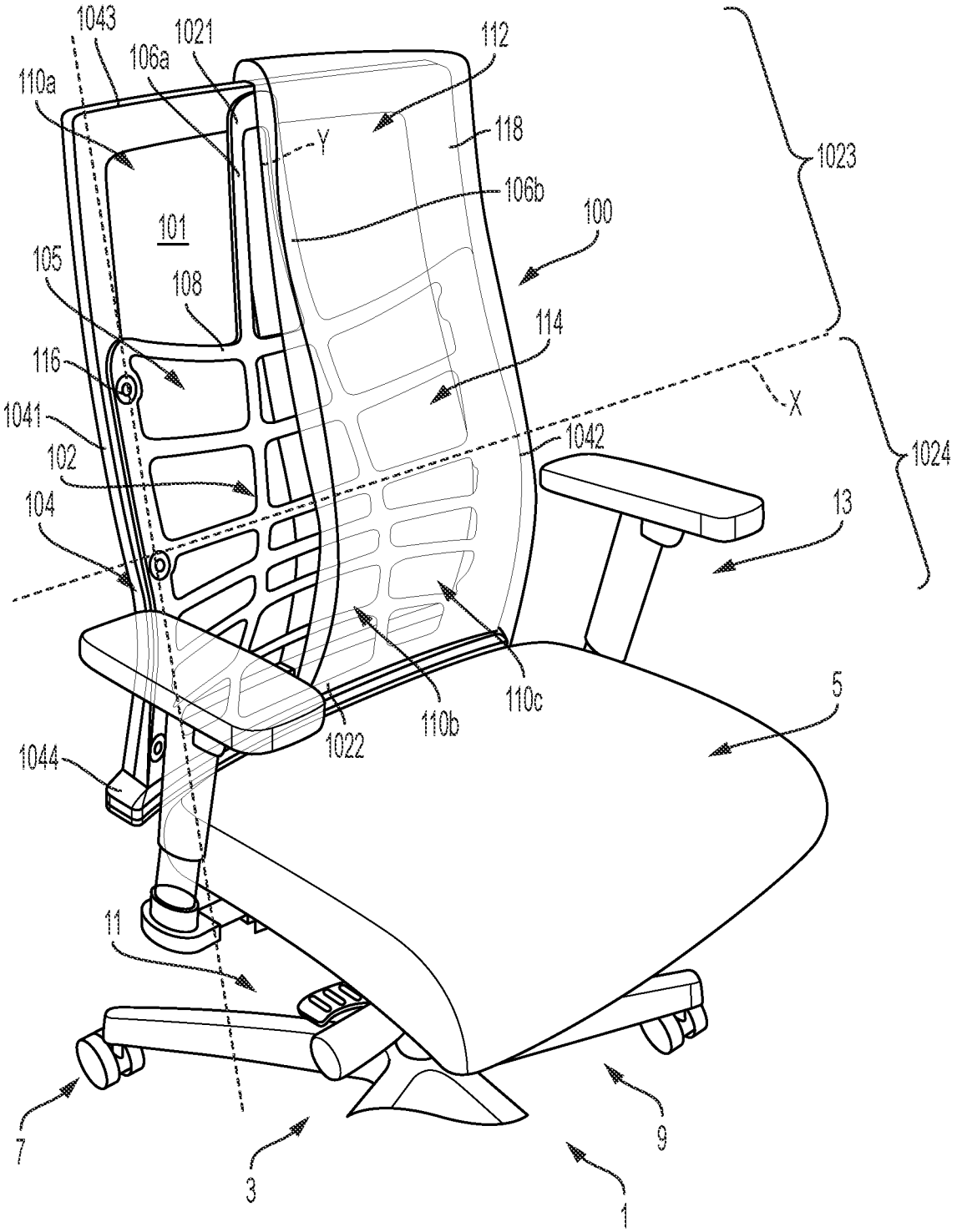
FIG. 2 is a perspective view of an exemplary embodiment of a chair back of the present invention similar to the chair back of FIG. 1, wherein the inner frame is coupled to the frame using fasteners and further includes a foam molding over the inner frame and the outer frame.

Referring initially to FIGS. 1 and 2, a chair 1 according to an illustrative embodiment is disclosed. The chair 1 may be used in a variety of environments, including an office building, a home office, a living space, a bedroom, outdoors, and anywhere a user may want to have a place to sit down. The chair 1 may include a base 3, which generally extends from a floor or the ground of the relative environment to support a seat 5. The seat 5 is configured to support a user during use, for example, for a user to sit upon. The base 3 may include wheels 7 (FIG. 2) to facilitate mobility of the chair 1 around the environment in which the chair 1 is being used. In other embodiments, the chair 1 may not include wheels 7 (FIG. 2), but may otherwise be removably placed on the floor or the ground of the environment in which the chair 1 is being used. For example, the base 3 may include legs 9 (FIG. 2) without wheels 7 (FIG. 2) which rest on the floor or the ground and further support the base. In yet other embodiments, the chair 1 may be fixedly attached to the floor or the ground through the use of cement, concrete, bolts, or other fastening means.

The base 3 may further include a height adjuster 11, which allows the user to adjust the height of the seat 5 to adapt to the environment and purpose for which the chair 1 is being utilized. In other words, the chair 1 may be a pneumatic chair. In such an embodiment, the chair 1 includes a gas cylinder (not shown) to store compressed air and a piston (not shown) coupled to the gas cylinder, both of which are built into the base 3. Upon actuation of the height adjuster 11 in a first direction, the piston enters the gas cylinder to further compress the air inside the cylinder, which raises the seat 5 of the chair 1. Upon actuation of the height adjuster 11 in a second direction, the piston exits the gas cylinder, decompressing the trapped air and causing the seat 5 to lower.

The chair 1 may also include arm rests 13, which extend from either the base 3 or the seat 5 to a position at which a user may comfortably rest his or her arms on the arm rests 13 while utilizing the chair 1. The arm rests 13 may be adjustable in height and direction to fit the needs of the user. A chair back 100 may also extend from the seat 5 or may be otherwise supported by the base 3 to a height at which the user may rest his or her back on the chair back 100. The chair back 100 may recline or may be varying degrees of rigidly upright depending on the needs of the user and the purpose of the chair 1.

Referring to FIG. 1, the chair back 100 of chair 1 is further disclosed. In the illustrative embodiment, the chair back 100 has an outer frame 104 forming an outer ring and defining an open central region 101. Specifically, the outer frame 104 includes a first side 1041, a second side 1042, a third side or top 1043, and a fourth side or bottom 1044 (FIG. 2) which are coupled to form a continuous perimeter defining the open central region 101. The chair back 100 further has an inner frame 102 forming a crossing-pattern or webbing of inner frame elements. Specifically, the inner frame 102 has a plurality of vertical frame elements 106 and at least one or more horizontal frame elements 108 which define a plurality of closed cells 112, the composite of which form a web-like structure 105.

Illustratively, the inner frame 102 and the outer frame 104 have varying resistance. For example, in an exemplary embodiment, the inner frame 102 may be comprised of an elastomer, such as thermoplastic vulcanizate or another thermoplastic elastomer. In such an embodiment, the outer frame 104 may be made of a more rigid polymer, such as glass-reinforced nylon or other reinforced composite polymers. In another embodiment, the inner frame 102 and the outer frame 104 may be comprised of the same material, wherein the outer frame 104 is manufactured in a manner so that the material is dense and rigid whereas the inner frame 102 is manufactured in a manner so that the material is relatively more flexible than the outer frame structure 104. The structural support of the chair back 100 is achieved through the rigidity of the outer frame 104, as seated contact with the frame is greatly minimized due to the design of the chair back 100 as described herein.

As discussed above, the inner frame 102 may form a web-like structure 105 to provide support to a back of a user.

For example, the inner frame 102 defines a longitudinal axis Y and a central latitudinal axis X, wherein the inner frame 102 may include at least a first vertical frame element 106*a* and a second vertical frame element 106*b* that correspond with the longitudinal axis Y to define a first vertical zone 110*a*, a second vertical zone 110*b*, and a third vertical zone 110*c*. In other embodiments, more or fewer vertical zones 110 may be included. In other words, the web-like structure 105 may provide additional or fewer vertical frame elements 106 defining additional or fewer vertical zones 110. The vertical frame elements 106 may have a similar or different arrangement to that portrayed by FIG. 1 relative to the longitudinal axis Y. The number and arrangement of vertical frame elements 106 determine the comfort level of the user, as well as the amount of support given to the user's spine.

As shown, the vertical zones 110 may change in size and shape along the longitudinal axis Y of the inner frame 102. For example, the first vertical frame element 106*a* and the second vertical frame element 106*b* may diverge from one another in a downward direction from a top 1021 of the inner frame 102 toward a bottom 1022 (FIG. 2) of the inner frame 102 so that the first vertical zone 110*a* and the third vertical zone 110*c* decrease in width in a downward direction from the top 1021 of the inner frame 102 toward the bottom 1022 (FIG. 2) of the inner frame 102 and the second vertical zone 110*b* increases in width in a downward direction from the top 1021 of the inner frame 102 toward the bottom 1022 of the inner frame 102.

The inner frame 102 may further include a plurality of horizontal frame elements 108 corresponding to the latitudinal axis X of the inner frame 102. The horizontal frame elements 108 form a crossing-pattern with the vertical frame elements 106 to define a plurality of closed cells 112, the composite of which form the web-like structure 105. The plurality of closed cells 112 are generally quadrilateral in shape and may be symmetric in a shape about the longitudinal axis Y of the inner frame 102.

The horizontal frame elements 108 further define a plurality of horizontal zones 114. Each of the horizontal zones 114 are separated by respective horizontal frame elements 108. In an illustrative embodiment, a first set of the plurality of horizontal frame elements 108 is located within an upper portion 1023 of the inner frame 102; the plurality of horizontal frame elements 108 defining the first set extending across the width of the inner frame 102 with a curvature toward the top 1021 of the inner frame 102. A second set of the plurality of horizontal frame elements 108 is located within a lower portion 1024 of the inner frame 102; the plurality of horizontal frame elements 108 defining the second set extending across the width of the inner frame 102 with a curvature toward the bottom 1022 of the inner frame 102. Generally, a majority of the horizontal frame elements 108 are located in the lower portion 1024 of the inner frame 102 to provide additional support along the perceived middle back and lumbar areas of a user's back, while the upper portion 1023 has fewer horizontal frame elements 108, giving less support along the latitudinal axis X of the inner frame 102 in the perceived areas of the user's shoulder blades. The arrangement of the horizontal frame elements 108 may, for example, define a saddle-shape in the mid-region of the inner frame 102 to provide additional support in the perceived lumbar area of the user's back. Additional or fewer horizontal frame elements 108 may be provided in a similar or different arrangement. For example, the upper portion 1023 may be substantially free of horizontal frame elements 108. The ability to modify the amount of support through alteration of the design of the support material in the inner frame 102 allows the benefit of a localized reaction.

To form the assembled chair back 100, the inner frame 102 and the outer frame 104 are formed and subsequently coupled so that the inner frame 102 is extended across the open central region 101 of the outer frame 104. Illustratively, the inner frame 102 and the outer frame 104 may be coupled through heat-staking. For example, the inner frame 102 and the outer frame 104 may be arranged in the desired formation described above and then undergo a pulsed-heat process that at least partially deforms the inner frame 102 and/or the outer frame 104 so that the inner frame 102 and the outer frame 104 are bonded together, i.e. melted together. Referring additionally to FIG. 2, in another embodiment, the inner frame 102 and the outer frame 104 may be coupled using fasteners 116, such as bolts, screws, nails, staples, adhesive, or other manners of coupling one thing to another.

Figure 3:
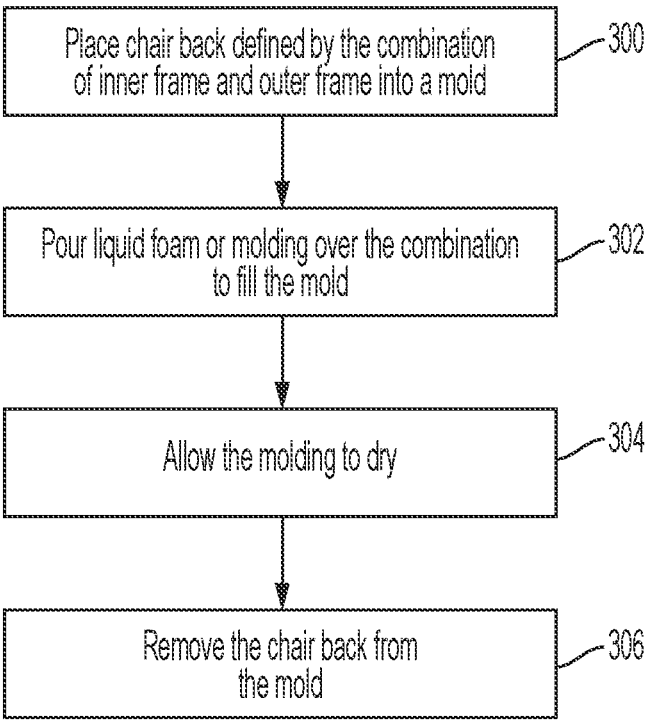
FIG. 3 is a diagrammatic view of a method for manufacturing the chair back of FIG. 1 or FIG. 2 with a foam molding.

Still referring to FIGS. 1 and 2, the chair 1 may include a foam layer 118 as shown in FIG. 2 and portrayed by the outline 118*b* in FIG. 1. In an illustrative embodiment, according to the method in FIG. 3, the combination of the coupled inner frame 102 and the outer frame 104 are placed in a mold corresponding to the desired shape of the chair back 100, according to box 300. Then, liquid foam, or molding, is poured over the combination to fill the mold of the chair back 100, according to box 302. As shown in box 304, the molding is permitted to dry so that the foam layer 118 may conform to and hold the shape of the mold. In this way, the foam layer 118 may fill the plurality of closed cells 112 of the inner frame 102. After the molding has completed drying, the chair back 100 is removed from the mold according to box 306 so that assembly of the chair 1 may be completed. In other embodiments, the foam layer 118 may be formed over the inner frame 102 and the outer frame 104 via injection molding or a casting process.

The foam layer 118 provides a level of comfort and support separate from the combination of the inner frame 102 and the outer frame 104. Where the web-like structure 105 exists under the foam layer 118, additional support is provided to a user. The web-like structure 105 may be modified as discussed above. For example, support material in the inner frame 102 may be removed where support is not needed to improve flow of the foam material.

Figure 4:
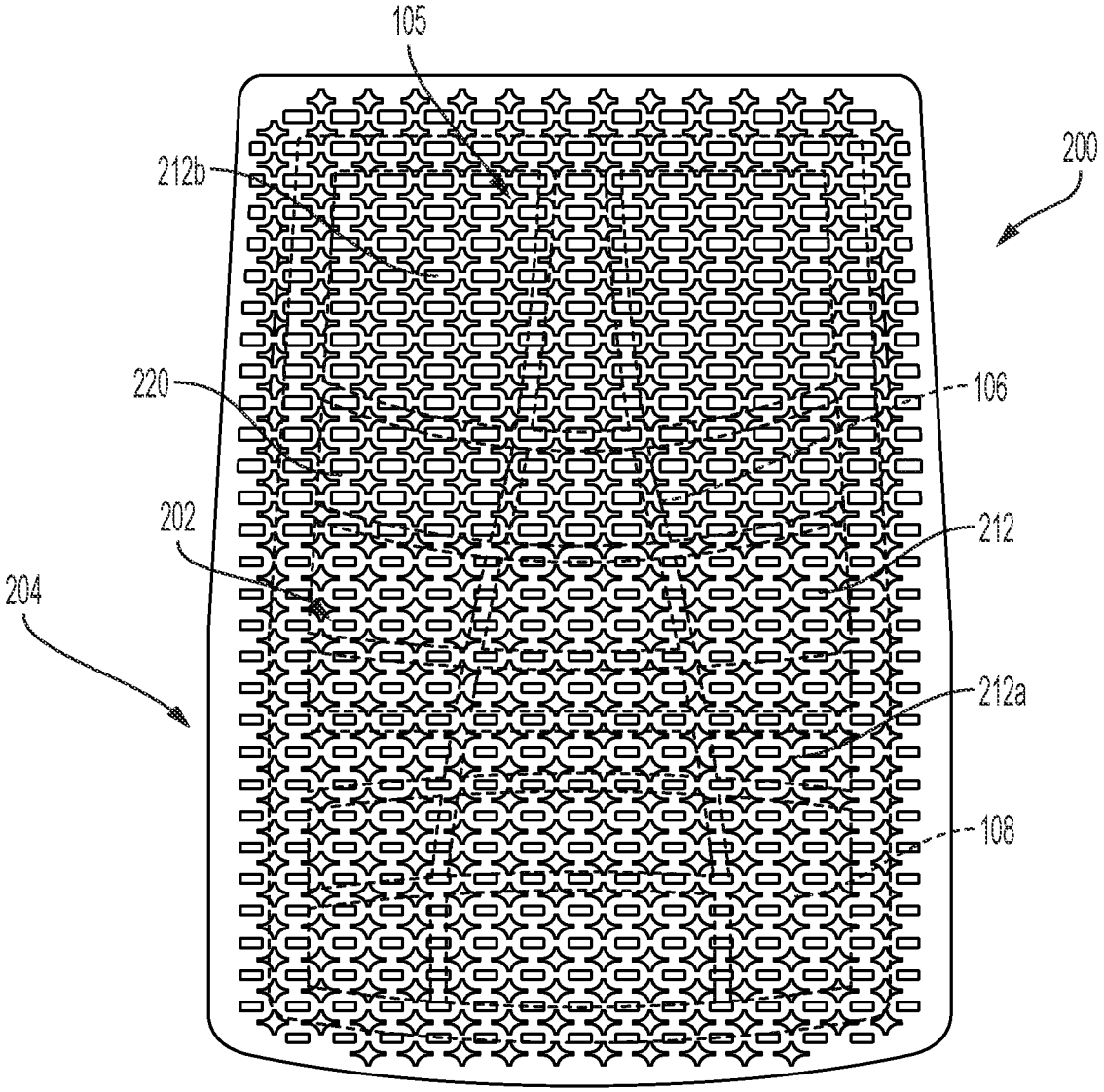
FIG. 4 is a front view of another exemplary embodiment of a chair back of the present invention similar to the chair back of FIG. 1, wherein the web-like structure is implemented through manipulation of scale size of individual scales present in the chair back.
Figure 5:
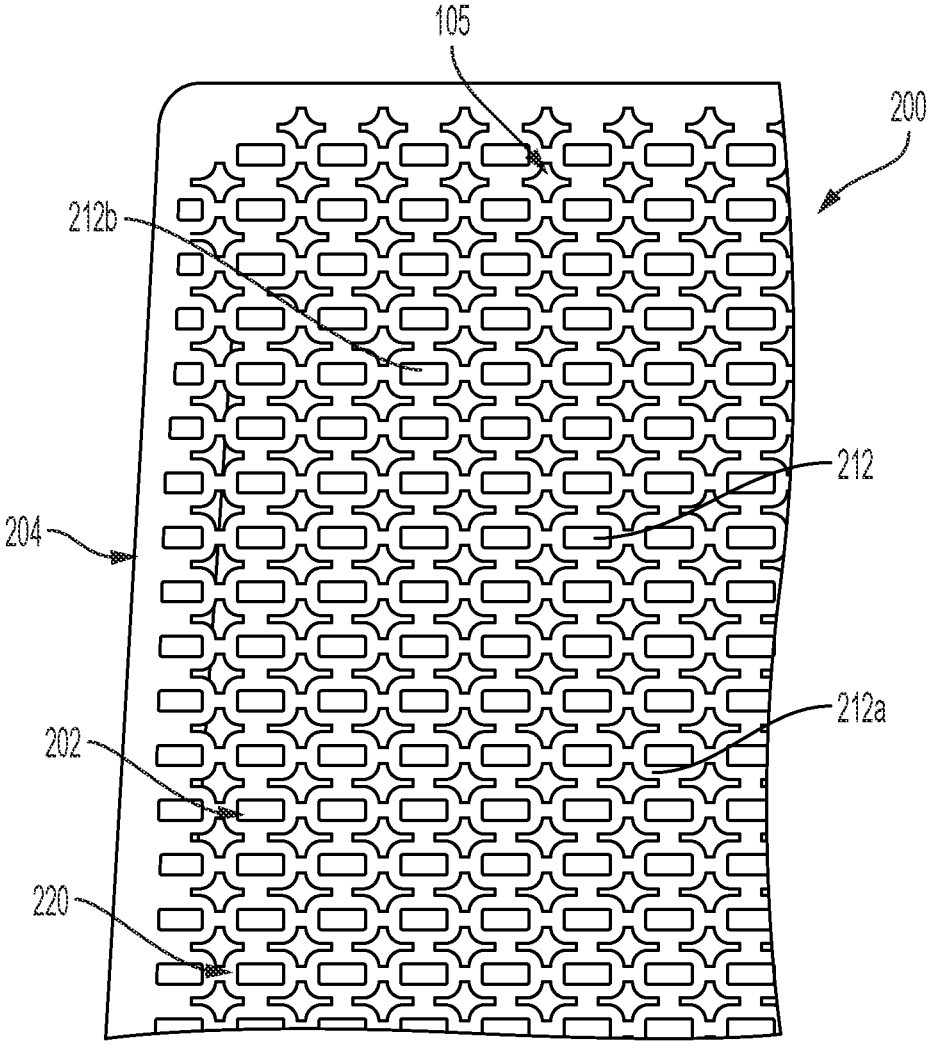
FIG. 5 is a close-up view of the scales of the chair back of FIG. 4, demonstrating the difference in scale size.

Referring now to FIGS. 4 and 5, another embodiment of a chair back 200 is disclosed. The chair back 200 includes an outer frame 204 and a body 202 comprised of a polymer forming a scale pattern 220 comprised of individual cells 212. In such an embodiment, the same web-like structure 105 is used, but instead of implementing the web-like structure 105 through an inner frame 102 (as shown in FIGS. 1 and 2), the structure is implemented through manipulation of the size of the individual cells 212. For illustration purposes, the web-like structure 105 of the present disclosure overlays the body 202 in FIG. 4. For example, where a vertical frame element 106 or a horizontal frame element 108 may be present in the inner frame 102 of the chair back 100 of the previous embodiment as shown in FIGS. 1 and 2, the size of an individual scale 212*a* is thicker and denser than the size of a lighter individual scale 212*b*, which is illustratively located where a horizontal zone within the web-like structure 105 of the inner frame 102 is located. The denser individual scale 212*a* provides greater resistance than the lighter individual scale 212*b*. Such an embodiment provides the beneficial support of the web-like structure 105 of the original embodiment without the additional step of foam-molding the chair back 200.

Various modifications and additions can be made to the exemplary embodiments discussed without departing from the scope of the present invention. For example, while the embodiments described above refer to particular features, the inventive scope also includes embodiments having different combinations of features and embodiments that do not include all of the above described features. For example, in another embodiment, a web-like structure 105 may be included in the seat 5 of the chair 1 to provide additional support to the user.

The following is claimed:

1. A chair back assembly, the chair back assembly comprising:

an outer frame defining an open central region and being formed of a frame material;

an inner frame coupled to the outer frame defining a central longitudinal axis and a central latitudinal axis, the inner frame extending across the open central region of the outer frame, the inner frame formed of a web material including a crossing-pattern of inner frame elements that define a plurality of closed cells that are symmetric in shape about the central longitudinal axis of the inner frame, the frame material being relatively more rigid than the web material, the inner frame elements including a first vertical frame element and a second vertical frame element, the first and second vertical frame elements diverging from one another in a downward direction from a top of the inner frame toward a bottom of the inner frame;

a foam layer enveloping the outer frame and the inner frame and filling the closed cells of the inner frame; and wherein each of the plurality of closed cells are defined by a width, and the width of at least four closed cells of the plurality of closed cells on at least one side of the chair back assembly consistently decrease from a top surface to a bottom surface of the chair back assembly.

2. The chair back assembly of claim 1, wherein the plurality of closed cells define a first vertical zone, a second vertical zone, and a third vertical zone, the first vertical zone being separated from the second vertical zone by the first vertical frame element and the second vertical zone being separated from the third vertical zone by the second vertical frame element.

3. The chair back assembly of claim 2, wherein the second vertical zone increases in width in a downward direction from a top of the inner frame element toward a bottom of the inner frame.

4. The chair back assembly of claim 2, wherein the first and third vertical zones decrease in width in a downward direction from a top of the inner frame element toward a bottom of the inner frame.

5. The chair back assembly of claim 1, wherein the inner frame elements include a plurality of horizontal frame elements such that the plurality of closed cells define a plurality of horizontal zones separated by the plurality of horizontal frame elements.

6. The chair back assembly of claim 5, wherein a first set of the plurality of horizontal frame elements extends across a width of the inner frame with an upward curvature and a second set of the plurality of horizontal frame elements extends across a width of the inner frame with a downward curvature, the first set being located on an upper portion of the inner frame and the second set being located on a lower portion of the inner frame.

7. The chair back assembly of claim 1, wherein a mid-region of the inner frame defines a saddle-shape.

8. The chair back assembly of claim 1, wherein at least a majority of the plurality of closed cells is generally quadrilateral in shape.

9. The chair back assembly of claim 1, wherein the frame material is glass-reinforced nylon.

10. The chair back assembly of claim 1, wherein the web material is thermoplastic vulcanizate.

11. The chair back assembly of claim 1, wherein the inner frame and the outer frame are coupled together.

12. The chair back assembly of claim 1, wherein the outer frame includes a first side, a second side, a top and a bottom defining a continuous perimeter encircling the open central region.

13. A chair back assembly, the chair back assembly comprising:

an outer frame defining an open central region and being formed of a frame material, the outer frame having at least a top side and a bottom side;

an inner frame coupled to the outer frame defining a central longitudinal axis and a central latitudinal axis, the inner frame extending across the open central region of the outer frame, the inner frame formed of a web material including a crossing-pattern of inner frame elements that define a plurality of closed cells that are symmetric in shape about the central longitudinal axis of the inner frame, the frame material being relatively more rigid than the web material, the web material having a top portion coupled with the outer frame only at a laterally central portion of the top side of the outer frame;

a foam layer enveloping the outer frame and the inner frame and filling the closed cells of the inner frame; and wherein each of the plurality of closed cells are defined by a width, and the width of the plurality of closed cells on at least one side of the chair back assembly consistently decrease from a top surface to a bottom surface of the chair back assembly.

14. A chair back assembly, the chair back assembly comprising:

an outer frame defining an open central region and being formed of a frame material;

an inner frame coupled to the outer frame defining a central longitudinal axis and a central latitudinal axis, the inner frame extending across the open central region of the outer frame, the inner frame formed of a web material including a crossing-pattern of inner frame elements that define a plurality of closed cells that are symmetric in shape about the central longitudinal axis of the inner frame, the frame material being relatively more rigid than the web material, wherein the inner frame elements include a first vertical frame element and a second vertical frame element, the first and second vertical frame elements diverging from one another along a portion of each closed cell in the plurality of closed cells;

a foam layer enveloping the outer frame and the inner frame and filling the closed cells of the inner frame; and wherein each of the plurality of closed cells are defined by a width, and the width of the plurality of closed cells on at least one side of the chair back assembly consistently decrease from a top surface to a bottom surface of the chair back.

15. The chair back assembly of claim 1, wherein the width of the plurality of closed cells on at least one other side of the chair back assembly consistently increase from a top surface to a bottom surface of the chair back assembly.

16. A chair back assembly, the chair back assembly comprising:

an outer frame defining an open central region and being formed of a frame material;

an inner frame coupled to the outer frame defining a central longitudinal axis and a central latitudinal axis, the inner frame extending across the open central region of the outer frame, the inner frame formed of a web material including a crossing-pattern of inner frame elements that define a plurality of closed cells that are symmetric in shape about the central longitudinal axis of the inner frame, the frame material being relatively more rigid than the web material;

a foam layer enveloping the outer frame and the inner frame and filling the closed cells of the inner frame; and wherein each of the plurality of closed cells are defined by a width, and the width of the plurality of closed cells on at least one zone of the chair back assembly consistently increase from a top surface to a bottom surface of the chair back assembly.

* * * * *